US006273331B1

(12) United States Patent
Kelley

(10) Patent No.: US 6,273,331 B1
(45) **Date of Patent: *Aug. 14, 2001**

(54) CENTER SUPPORTED DISPLAY BOX

(75) Inventor: Terry G. Kelley, Kirkland, WA (US)

(73) Assignee: Consumer Choice Systems, Inc., Bellevue, WA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/164,532

(22) Filed: Sep. 30, 1998

(51) Int. Cl.[7] ..... B65D 25/04; B65D 23/00

(52) U.S. Cl. ..... 229/120.11; 229/120.01; 229/120.03; 229/153

(58) Field of Search ..... 229/120.11, 120.03, 229/120.05, 120.08, 122.2, 115, 153, 120.02, 120.011, 120.01, 120.12, 141

(56) References Cited

U.S. PATENT DOCUMENTS 1,035,258 * 8/1912 Stegman ..... 229/220.011
2,745,588 * 5/1956 Dunning ..... 229/220.011
2,983,424 * 5/1961 Glass ..... 229/220.011
3,397,771 * 8/1968 Fogle ..... 229/115
3,785,545 * 1/1974 Roussel ..... 229/220.011 X
3,985,288 * 10/1976 Bell ..... 229/115
4,485,926 * 12/1984 Lenzmeier ..... 229/220.011
4,530,685 * 7/1985 Freeman ..... 229/220.011
5,180,056 * 1/1993 Adams et al. ..... 229/220.011 X

* cited by examiner

*Primary Examiner*—Allan N. Shoap
*Assistant Examiner*—Tri M. Mai
(74) *Attorney, Agent, or Firm*—Townsend and Townsend and Crew, LLP

(57) ABSTRACT

A display carton comprising two enclosed product containing spaces formed from a blank is formed about a series of diametrically opposed fold lines. The carton has a bottom panel closure comprising a triangular center foldable tab securable by the bottom panel closure which provides a balanced structure which is rigid and stands secure on a shelf and is printed on only a single side.

5 Claims, 7 Drawing Sheets

CENTER SUPPORTED DISPLAY BOX

FIELD OF THE INVENTION

The present invention relates generally to the field of display cartons formed from a carton blank for holding containers, and more particularly to a display carton for holding two vertically elongated filled containers in a side-by-side relationship.

BACKGROUND OF THE INVENTION

The present invention relates to a carton which is used to display securely two product containers which are vertically elongated. Prior to the invention cartons of this general type have been disadvantaged in that they are typically designed to display the product containers horizontally so as to provide stability when placed on a store shelf. When designed to display the product vertically the display carton either utilizes unused space to provide a larger surface to stabilize the display carton on the store shelf, or the carton requires a specially designed store shelf to secure the carton. Further, prior display cartons of this general type tended to be relatively complicated structures requiring several cutting, bending and folding operations in order to form the carton, or require printing on both sides of the carton.

SUMMARY OF THE INVENTION

One object of the present invention is to provide a display carton having two enclosed container spaces for vertically elongated product containers which is rigid and stays fixed on a store shelf.

Another object of the invention is to provide a display carton which can be made from a single flat blank of fiber board material.

Still another object of the present invention is to provide a carton which requires printing or finishing on a single side of the flat blank.

Thus, in one embodiment the invention provides a carton comprising two container spaces for vertically elongated product containers which are in side-by-side relation, joined along a common side. The carton also has a bottom panel closure, cut from a single panel which provides the bottom closure for each of the two product containers, and a foldable center support securable by the bottom panel closure to provide rigidity and a balanced display carton.

In general, the subject carton comprises two elongated enclosed container spaces each having a separate first end closure, and each elongated enclosed container space comprising four lengthwise extending side panels and a lengthwise extending glue tab partial side panel. The carton further comprises a plurality of spaced-apart side panels joined on at least one common side, foldable and securable in lapped relation and erectable into the display carton. The carton also comprises two top panel closures and a single bottom panel closure. The bottom panel has a foldable triangular tab securable by the bottom panel which provides a center support. The carton can be secured with additional drop flaps and lock flaps.

DETAILED DESCRIPTION OF THE SPECIFIC EMBODIMENTS

Figure 1:
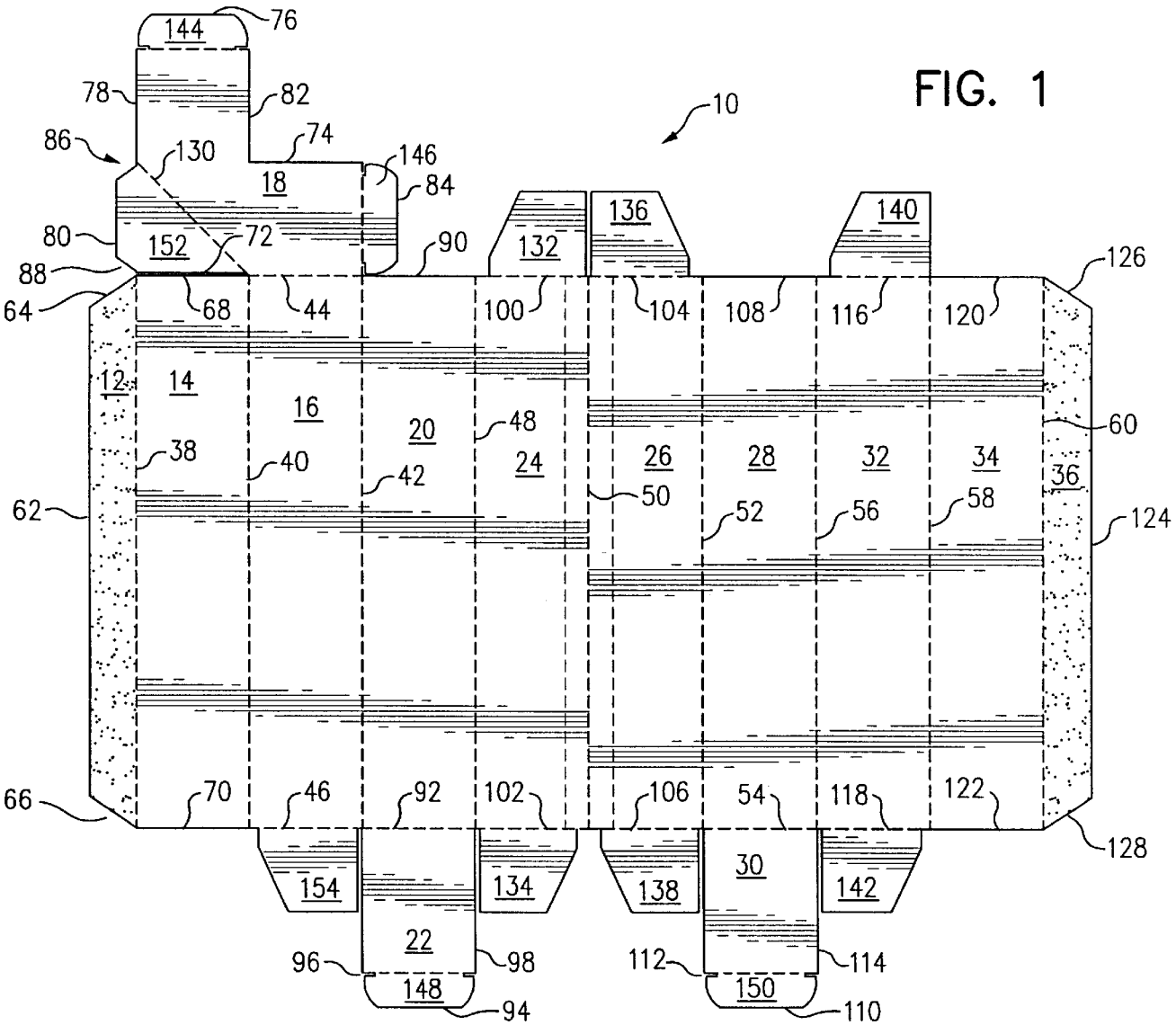
FIG. 1 is an elevational view of one embodiment of a flat blank.

Referring more particularly to FIG. 1 of the drawings, there is shown therein a flat blank of carton material, such as craft paperboard, cardboard or the like, generally indicated at 10, embodying the principles of the present invention. The blank 10 is foldable and securable in lapped relation in a flattened preform condition, such as in FIG. 2, and then is erectable into a display carton, as shown in FIGS. 4—10. As shown in FIG. 1, the blank 10 is cut and scored to form an array of panels which are designated by numerals 12, 14, 16, 18, 20, 22, 24, 26, 28, 30, 32, 34 and 36. The panels are joined on common sides 38, 40, 42, 44, 46, 48, 50, 52, 54, 56, 58 and 60. Each panel is defined by four sides including one to three common sides. As shown, panel 12 is a partial width first side panel defined by common side 38, a cut parallel side 62 and two cut angled sides 64 and 66. Panel 14 is a first full side panel defined on two sides by the parallel common sides 38 and 40 and by two perpendicular cut sides 68 and 70. Panel 16 is a second side panel defined on two sides by parallel common sides 40 and 42 and by two perpendicular sides. The first perpendicular side is common side 44, the second side 46 is perpendicular to side 44. Panel 18 is a bottom panel defined by common side 44 and collinear with cut side 72, by parallel cut sides 74 and 76, perpendicular cut sides 78, 80, 82 and 84, and angled out sides 86 and 88 interconnecting sides 72, 78 and 80. Panel 20 is a third side panel defined on two sides by parallel common sides 42 and 48 and by perpendicular cut panel 90 and common side 92. Panel 22 is a first top panel extending in the opposite direction as panel 13 defined by common side 92, parallel cut side 94, and perpendicular cut sides 96 and 98.

Panel 24 is a fourth side panel defined on two sides by parallel common sides 48 and 50 and perpendicular sides 100 and 102. Panel 26 is a fifth side panel defined on two sides by parallel common sides 50 and 52, and perpendicular sides 104 and 106. Panel 28 is a sixth side panel defined on two sides by common sides 52 and 56, and by perpendicular common side 54 and perpendicular cut side 108. Panel 30 is a second top panel defined on two sides by common side 54 and parallel cut side 110, and by perpendicular cut sides 112 and 114. Panel 32 is a seventh side panel defined on two sides by parallel common sides 56 and 58 and by perpendicular sides 116 and 118. Panel 34 is an eighth side panel defined on two sides by parallel common sides 58 and 60 and by perpendicular cut sides 120 and 122. Panel 36 is a second partial side panel defined by common side 60, parallel cut side 124 and two angled cut sides 126 and 128.

The carton material along the non-cut perpendicular sides is cut to form drop flaps 154, 132, 134, 136, 138, 140 and 142. As shown, each drop flap has a common side with one of the panel sides and the remaining periphery thereof cut. As shown, the second side panel 16 has side 46 in common with drop flap 130, the fourth side panel 24 has sides 100 and 102 common with drop flaps 132 and 134, the fifth side panel 26 has sides 104 and 106 common with drop flaps 136 and 138, and the seventh side panel 32 has sides 116 and 118 common with drop flaps 140 and 142.

Each of the common sides is scored to assist in folding. The nature of the scoring utilized to define the panel side will be dependent upon the particular carton material utilized in the blank. In the arrangement shown, the sides are formed both by a crease line and, in the case of common side 50, perforations which serve to facilitate folding. In addition, fold line 130 extends from the junction of cut side 72 and common side 44 to the junction of cut side 78 and cut side 86. When folded along fold line 130 bottom, tab 152 is placed in bottom panel 18.

It will be understood that the blank 10 includes one flat surface which is finished and printed and an opposite surface which is unfinished. As shown by stippling in FIG. 1, the finished surface of the blank 10 is provided with an adhesive or the like along the partial width side panels 12 and 36, and on the opposite surface along side panels 24 and 26 adjacent to common side 50.

Figure 2:
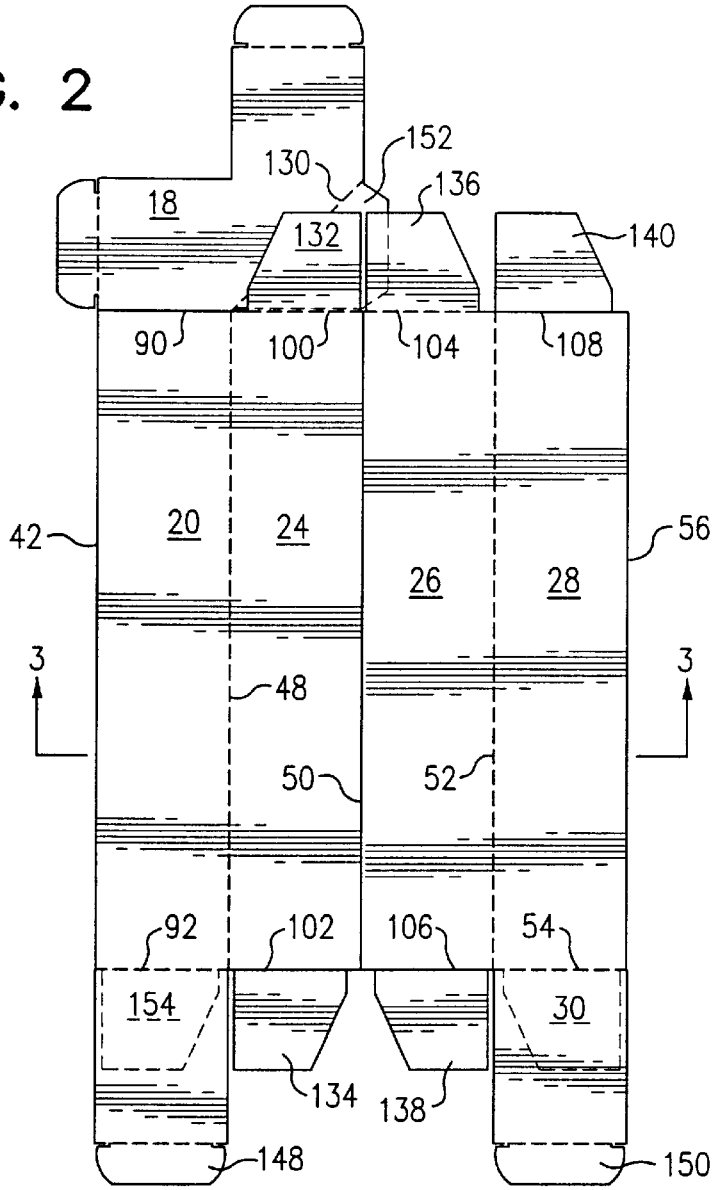
FIG. 2 is an elevational view of the flat blank in its flattened preformed condition.
Figure 3:
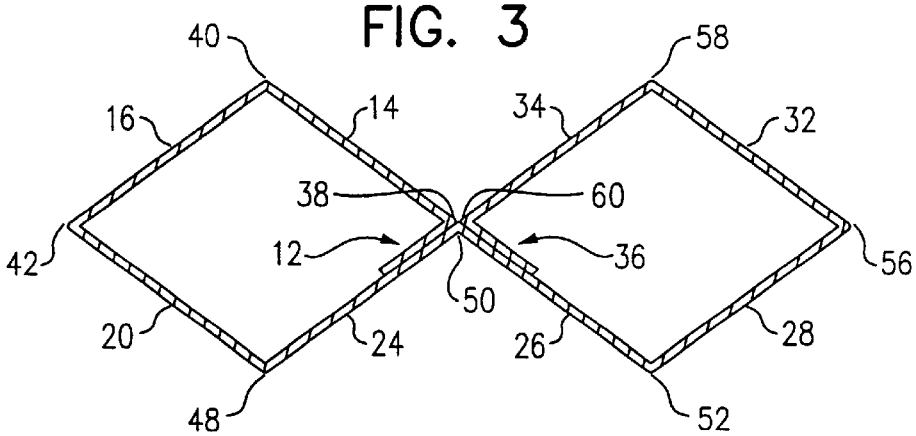
FIG. 3 is a sectional view taken along the line 3—3 of FIG. 2.
Figure 4:
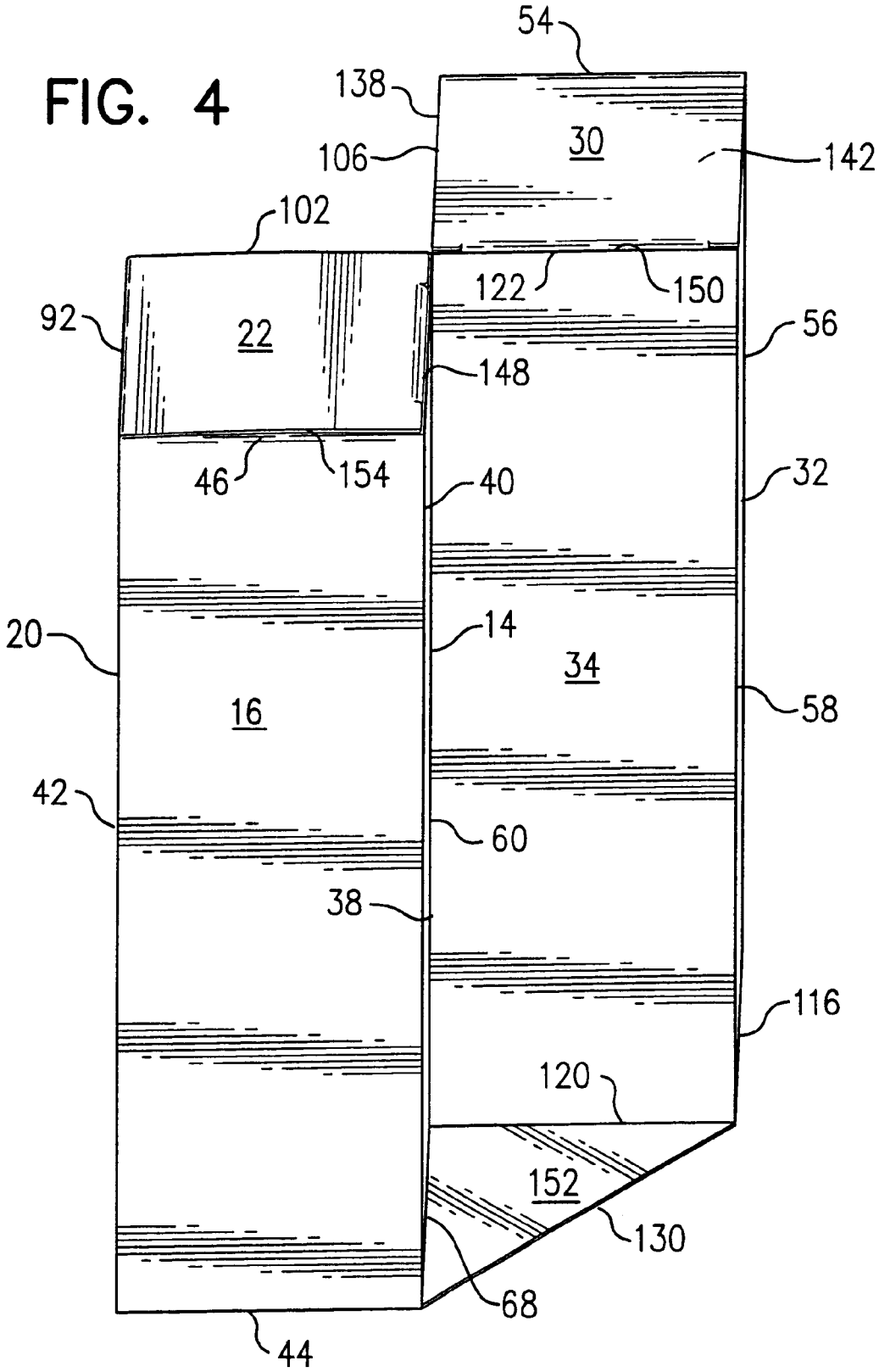
FIG. 4 is a perspective view of the back of the carton showing the upper surface of the triangular tab in its secured position.
Figure 6:
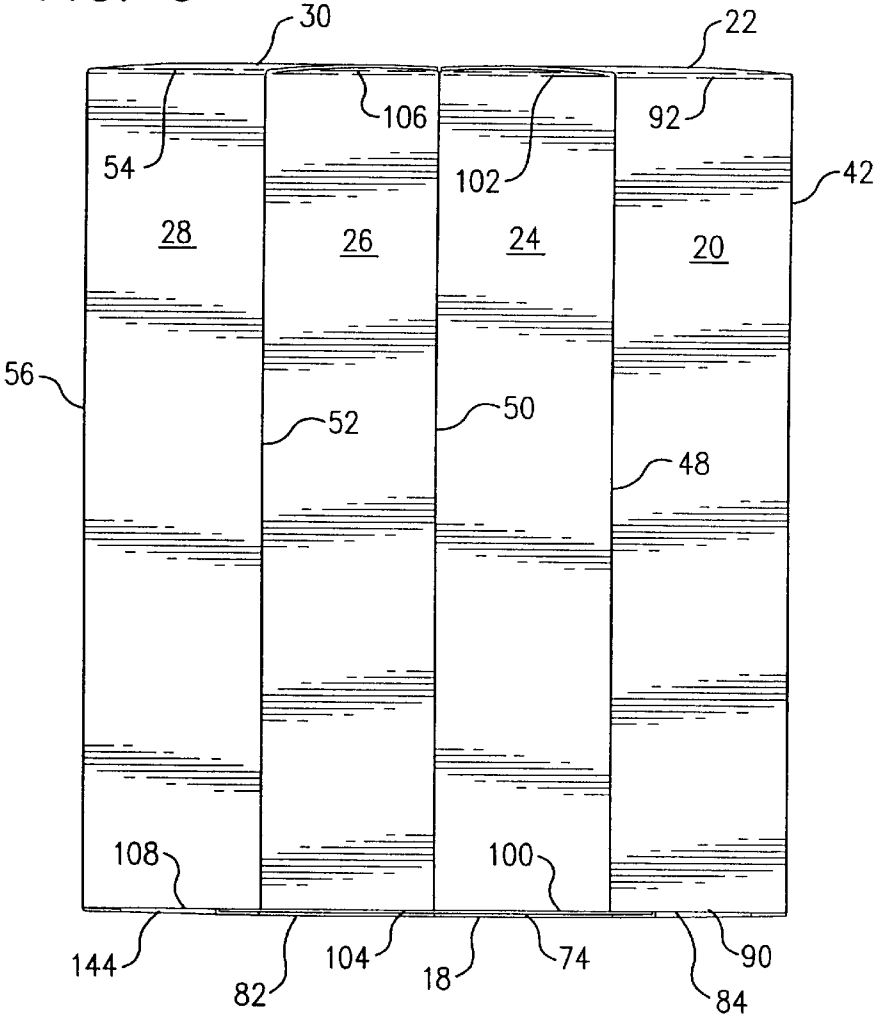
FIG. 6 is a front view of the blank in its erected product-containing form.
Figure 5:
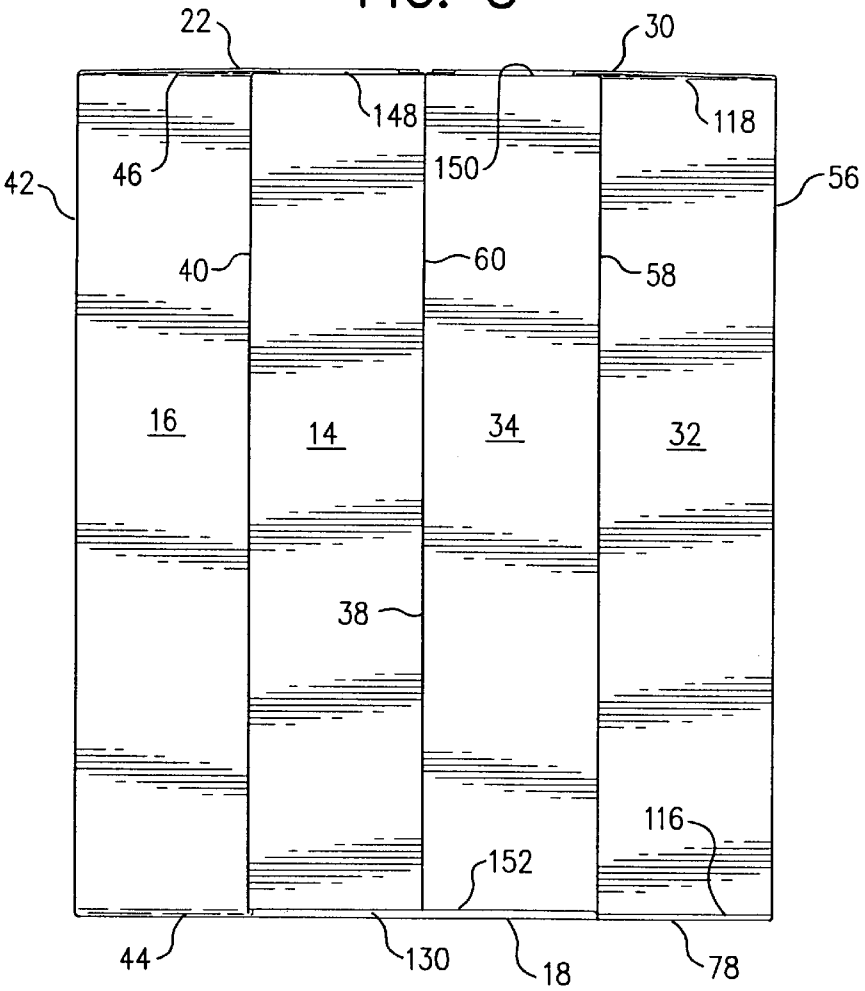
FIG. 5 is a back view of the blank in its erected product-containing form.
Figure 7:
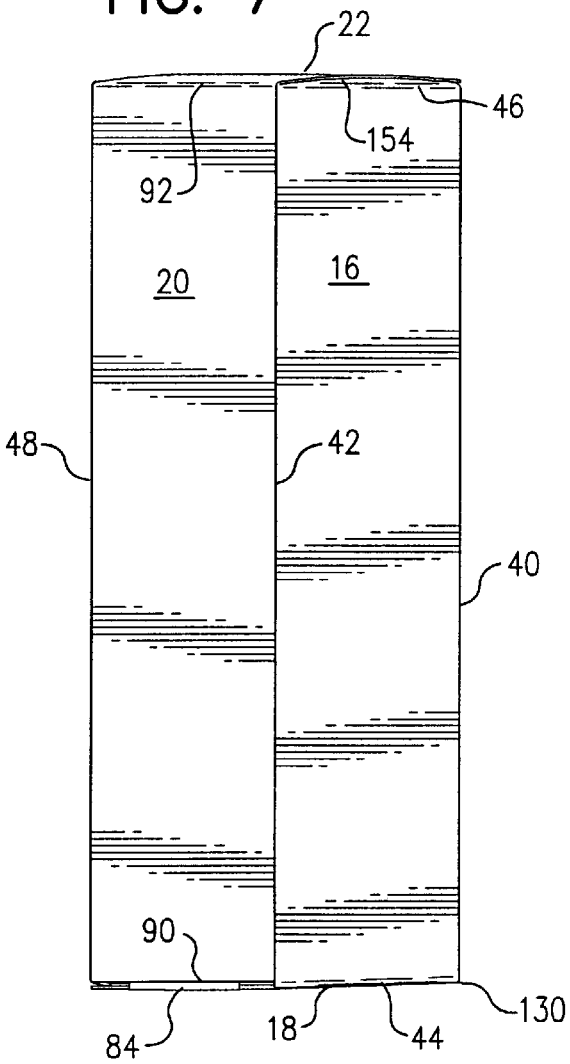
FIG. 7 is a left side view of the blank in its erected product-containing form.
Figure 8:
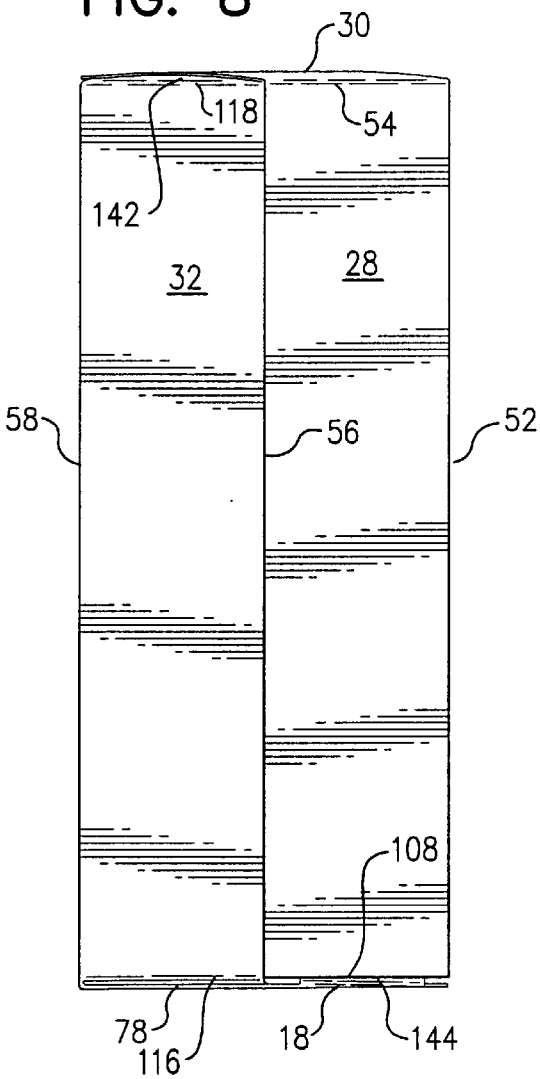
FIG. 8 is a right side view of the blank in its erected product-containing form.
Figure 9:
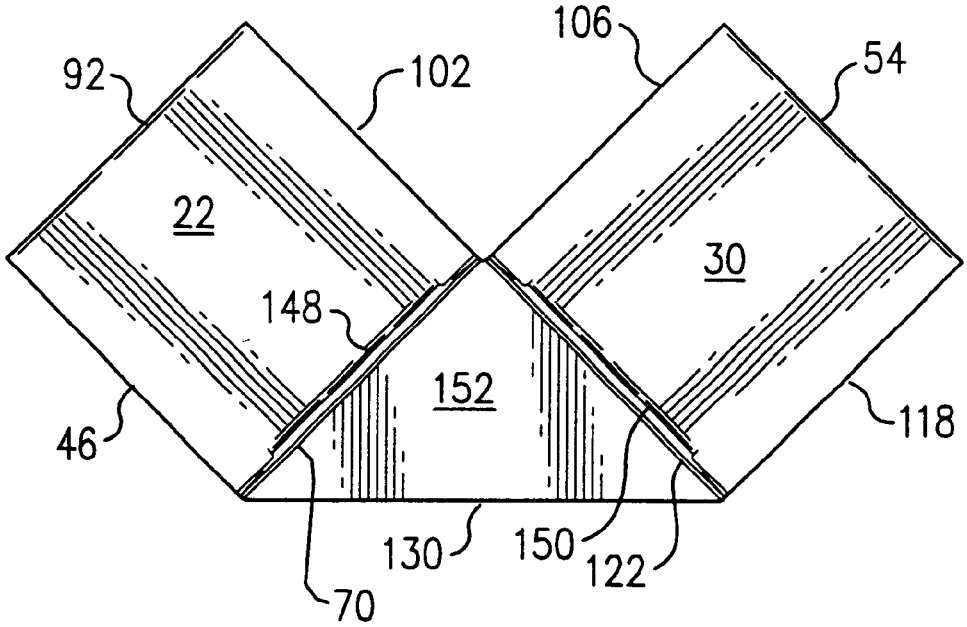
FIG. 9 is a top view of the blank in its erected product-containing form.
Figure 10:
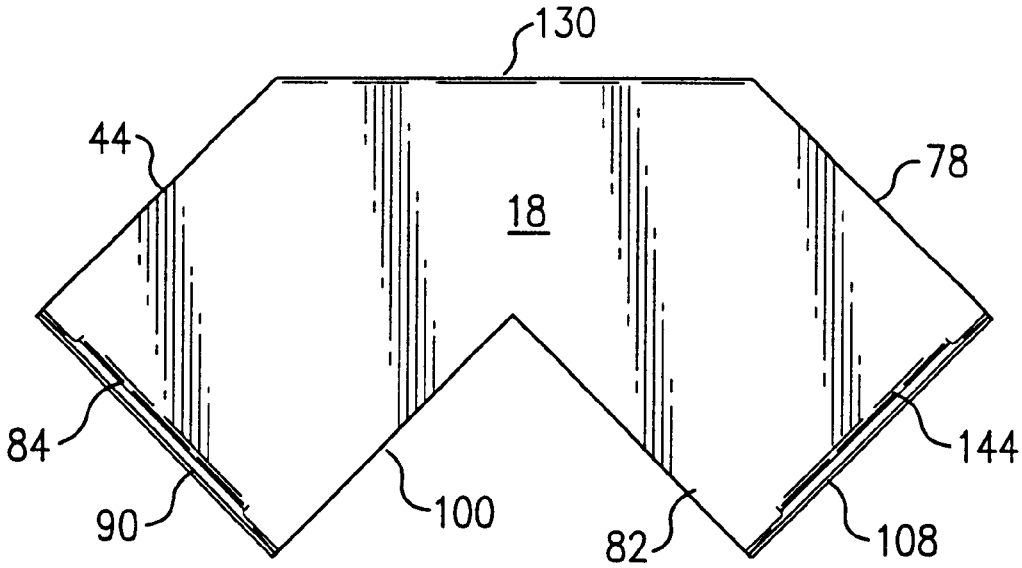
FIG. 10 is a bottom view of the blank in its erected product-containing form.
Figure 11:
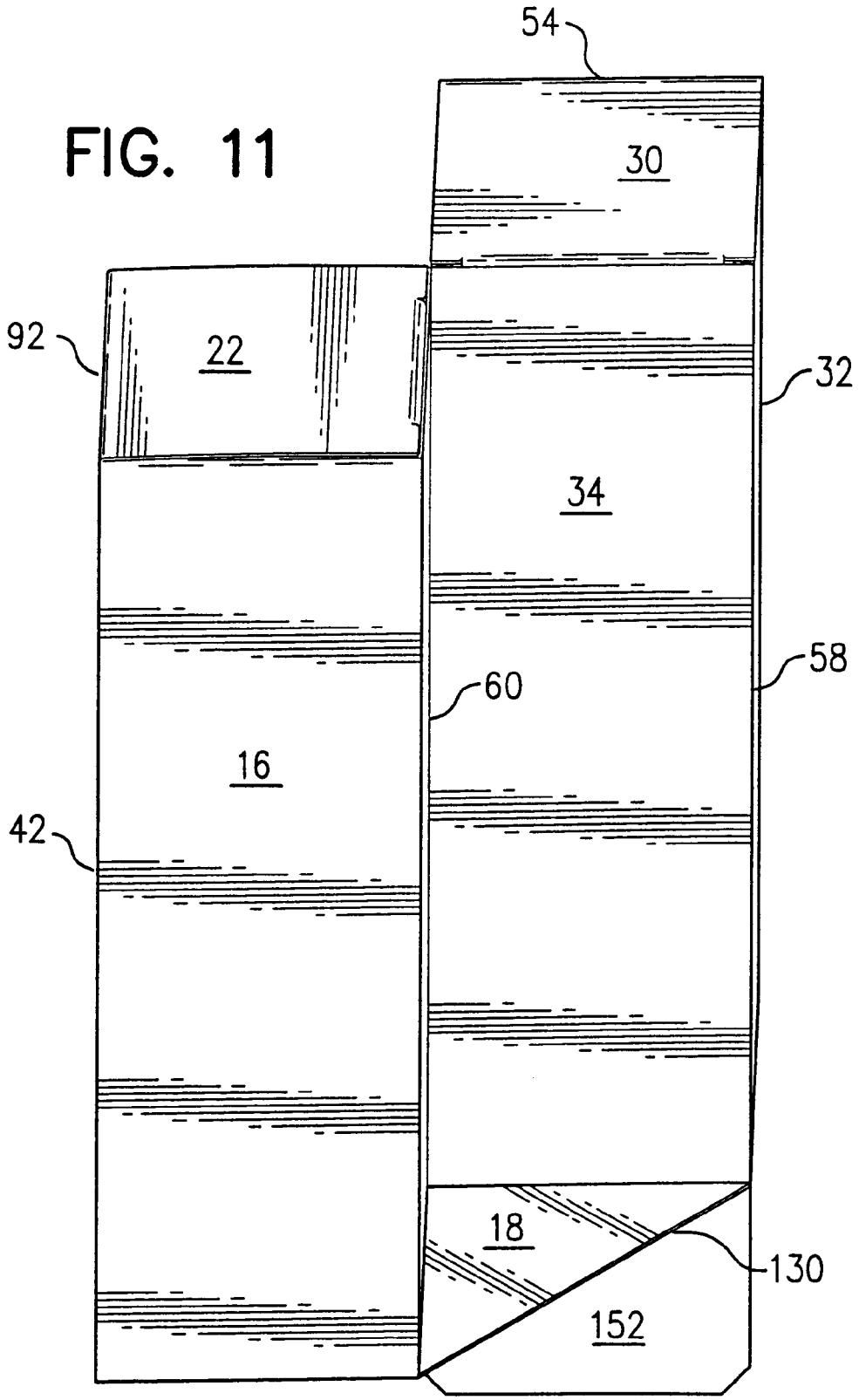
FIG. 11 is another perspective view of the carton showing the bottom tab.

In folding the blank 10 into its flattened preformed condition as shown in FIG. 2, partial side panel 12 is folded along common side 38 so as to bring the outer section of side panel 12 into engagement with the opposite surface of side panel 24 adjacent to common side 50, so that the glue or other adhesive on the outer surface of panel 12 and opposite surface of side panel 24 adjacent to common side 50 retains the two sections in finished surface to opposite surface engagement. Further, partial side panel 36 is folded along common side 60 so as to bring the outer section of side panel 36 into engagement with the opposite surface of side panel 26 adjacent to common side 50, so that the glue on the outer finished surface of partial side panel 36 and opposite surface of side panel 26 adjacent to common side 50 retains the two sections in finished surface to opposite surface engagement. The blank in its folded and glued condition constitutes an integral structure comprising two separate panel structures, the first of which has a hinge connection provided by common side 42, placing side panels 14 and 16 in opposite-surface overlapping opposite-surface relation with side panels 24 and 20 respectively. The second panel structure has a hinge connection provided by common side 56, placing side panels 26 and 28 into opposite-surface opposite-surface overlapping relation with side panel 34 and 32 respectively. This flattened preformed condition blank, wherein the blank is folded about certain common sides and secured in lapped relation, as by glue or the like, as previously noted, is illustrated in FIGS. 2 and 3. It will be noted that the two top panels 22 and 30 are positioned so as to be opposite the bottom panel 18.

The common side 50 defines one side of the first and second panel structures when the blank is erected from its flattened preformed condition into a condition comprising two enclosed spaces for product containment. This erecting movement can be accomplished by hand or preferably by packaging machinery capable of feeding successive blanks in flattened preformed condition from a supply stack so as to be initially erected into a two enclosed space condition for receiving the products, wherein the panel structures of each pair of side-by-side panel structures are moved from side-by-side relation into perpendicular relation with respect to one another.

The packaging machinery is typically also operable to fold the bottom tab 152 along fold line 130 such that tab 152 is in opposite-surface to opposite-surface overlapping relation with bottom panel 18, and typically is further operable so as to fold side flaps 132, 136 and 140 into closing relationship, secured by folding bottom panel 18 along common side 44 such that lock flaps 144 and 146 insert into the first and second panel structures to form a closed end of each enclosed product-containing space. The lock flaps can be secured in a closing relation by any suitable means, such as glue or the like. Each enclosed space for product containment is fitted with product, such as, for example, vertically elongated tubes containing one part of a two part cosmetic, nutritional, diagnostic or pharmaceutical product, or the like. After fitting with product the packaging machinery is typically also operable so as to fold drop flaps 154, 134, 138 and 142, and the top panels 22 and 30 into a closing relationship to form a second closed end of each enclosed product containing structure. The top panels are secured by lock flaps 148 and 150 which can be further secured in closing relation by any suitable means such as glue. This complete display structure condition of blank 10 is shown in FIGS. 4–10 and constitutes the display condition of the blank. In this position, it will be noted that the two enclosed product containing structures form a free standing container wherein the enclosed product-containing structures are joined by common side 50 and each enclosed product-containing structure is closed at the bottom by a single panel having a triangular center-folded bottom tab which balances the display structure so that the display package stands rigid and secure on a shelf without the necessity of additional support or other reinforcement. The embodiment of the invention has the advantage of allowing the blank to be printed on only one side and providing two complete enclosed product-containing structures with the finished printed surface on all displayed sides.

It thus will be seen that the objects of this invention have been fully and effectively described. It will be realized, however, that the foregoing preferred specific embodiments have been shown and described for the purpose of illustrating the functional and structural principles of the present invention and are subject to change and modification without departure from such principles. Therefore, this invention includes all modifications encompassed within the spirit and scope of the following claims.

What is claimed is:

1. A display carton defining two tubular containers in side-by-side relation joined along a common fold line, each of said containers having front wall and rear wall panels, opposing side wall panels and a top panel for closing adjacent openings at one end of said carton, a wall panel of each of said containers of said carton together forming a V-shaped space, said carton having a single bottom closure panel for closing adjacent openings at the other end of said carton, said closure panel having a first portion and a second portion, said second portion being defined by a triangular folded tab, said tab being folded in an overlapping relationship with said first portion and secured to said first portion, and said tab being secured to said carton such that said second portion extends into said V-shaped space.

2. The carton of claim 1, wherein said top panel and said bottom closure panel are secured by lock flaps.

3. The carton of claim 1, wherein said carton is finished on one side.

4. A blank for forming a carton, the blank comprising a plurality of wall panels joined along foldable lines to form two vertically elongated enclosed containers, each of said containers having front and rear wall panels, opposed side wall panels and a top panel for closing adjacent openings at one end of said carton, a single L-shaped bottom closure panel foldably connected to one of said wall panels at an end thereof for closing adjacent openings at the other end of said carton, said closure panel having a first portion and a second portion connected to said first portion along a fold line at a heel portion of said L-shaped bottom closure, said second portion defined by a triangular folded tab for overlappingly securing to said first portion when said carton is erected.

5. The blank of claim 4, further comprising drop flaps foldably connected to at least one of said wall panels.

* * * * *